US005673818A

United States Patent [19]

Kaneski et al.

[11] Patent Number: 5,673,818

[45] Date of Patent: *Oct. 7, 1997

[54] PAINT TOTE WITH COLLAPSIBLE LINER

[75] Inventors: Donald E. Kaneski, Highridge, Miss.; Ross G. Good, South Lyon, Mich.

[73] Assignee: Chrysler Corporation, Auburn Hills, Mich.

[ * ] Notice: The term of this patent shall not extend beyond the expiration date of Pat. No. 5,575,560.

[21] Appl. No.: 503,967

[22] Filed: Jul. 19, 1995

[51] Int. Cl.[6] ..... B65D 35/56

[52] U.S. Cl. ..... 222/105; 222/386.5

[58] Field of Search ..... 222/71, 105, 386.5, 222/388, 387; 73/149, 290 R, 861

[56] References Cited

U.S. PATENT DOCUMENTS

| | | | |
|---|---|---|---|
| 1,254,429 | 1/1918 | Parmeley . | |
| 1,293,951 | 2/1919 | Shevalier . | |
| 1,342,212 | 6/1920 | Hainsey . | |
| 1,436,778 | 11/1922 | Rowe et al. . | |
| 1,944,042 | 1/1934 | Thompson | 220/65 |
| 2,431,872 | 12/1947 | Kavula | 259/75 |
| 2,578,918 | 12/1951 | Boddy et al. | 91/43 |
| 3,128,082 | 4/1964 | Cline | 259/72 |
| 3,271,012 | 9/1966 | VanBael | 259/29 |
| 3,321,070 | 5/1967 | Childs | 206/46 |
| 3,363,461 | 1/1968 | Minkoff | 73/194 |
| 3,377,987 | 4/1968 | Juvinall et al. | 118/626 |
| 3,643,854 | 2/1972 | Holmes | 229/14 |
| 3,995,839 | 12/1976 | Zingg | 259/22 |
| 4,834,261 | 5/1989 | Brdlik | 220/404 |
| 4,907,723 | 3/1990 | Katz | 222/105 |
| 4,949,988 | 8/1990 | Schutz | 222/105 |
| 4,960,227 | 10/1990 | Coleman | 222/94 |
| 5,050,438 | 9/1991 | Ezell, Jr. | 73/862 |
| 5,094,543 | 3/1992 | Mursa | 366/247 |
| 5,215,253 | 6/1993 | Saidman et al. | 239/61 |
| 5,230,739 | 7/1993 | Bartow | 118/694 |
| 5,265,766 | 11/1993 | Kurtzahn et al. | 222/105 |
| 5,273,357 | 12/1993 | Currie | 366/110 |
| 5,309,403 | 5/1994 | Bartow | 366/130 |
| 5,339,989 | 8/1994 | Coleman | 222/105 |
| 5,575,560 | 11/1996 | Kaneski et al. | 222/386.5 |

*Primary Examiner*—Philippe Derakshani
*Attorney, Agent, or Firm*—Edward A. Craig

[57] ABSTRACT

A tote tank has a flexible, collapsible liner for water-based or water-borne paint. The liner when full of paint fills the tank and lines the interior walls thereof. A paint outlet from the liner extends through a wall of the tank for withdrawing paint. A paint inlet to the liner is provided for filling the liner with paint and is normally closed and sealed by a closure plate. An air inlet to the tank allows the liner to collapse as paint is withdrawn. An air meter measures the amount of air entering the tank through the air inlet as an indication or measure of the amount of paint withdrawn.

4 Claims, 1 Drawing Sheet

PAINT TOTE WITH COLLAPSIBLE LINER

This application contains subject matter disclosed in our prior application, Ser. No. 08/512,984, filed Aug. 9, 1995, now U.S. Pat. No. 5,575,560, issued Nov. 9, 1996.

FIELD OF THE INVENTION

This invention relates generally to paint totes and refers more particularly to a paint tote with a collapsible liner.

BACKGROUND AND SUMMARY

Water-based or water-borne paints are being used more often in the manufacture of motor vehicles. Water-based paints do not contain harmful solvents which have contributed to air pollution problems in the past. However, certain problems have been encountered with water-based paints.

It has been learned, for example, that when water-based paints are stored in tote tanks made of stainless steel, paint particles form which dry and adhere to the inner surface of the tank as the level of paint drops. These particles become intermixed with the paint and the result is an imperfect coat of paint on the motor vehicle or other article being painted.

This problem has been resolved by providing a collapsible plastic liner within the tote tank. The paint is contained in the liner and the liner collapses as the paint is used up, thereby preventing paint from forming on the surface thereof. An air opening into the tank is preferably provided to allow for the uninhibited collapse of the liner and to fill with air that portion of the tank not occupied by the liner as the liner collapses.

Preferably, means are provided for measuring the volume of air entering the tank which is an indication of the amount of paint withdrawn or dispensed. This information may be useful in determining how much paint is being used in a given day and also for environmental control purposes. Preferably, the liner is made of a resinous plastic material such, for example, as polyethylene.

One object of this invention is to provide a paint tote having the foregoing features and capabilities.

Another object is to provide a paint tote which is made of a relatively few simple parts, is rugged and durable in use, and is capable of being readily and inexpensively manufactured and assembled.

Other objects, features and advantages of the invention will become more apparent as the following description proceeds, especially when considered with the accompanying drawings.

DETAILED DESCRIPTION OF A PREFERRED EMBODIMENT

Figures 1, 2, 3, 4, 5:
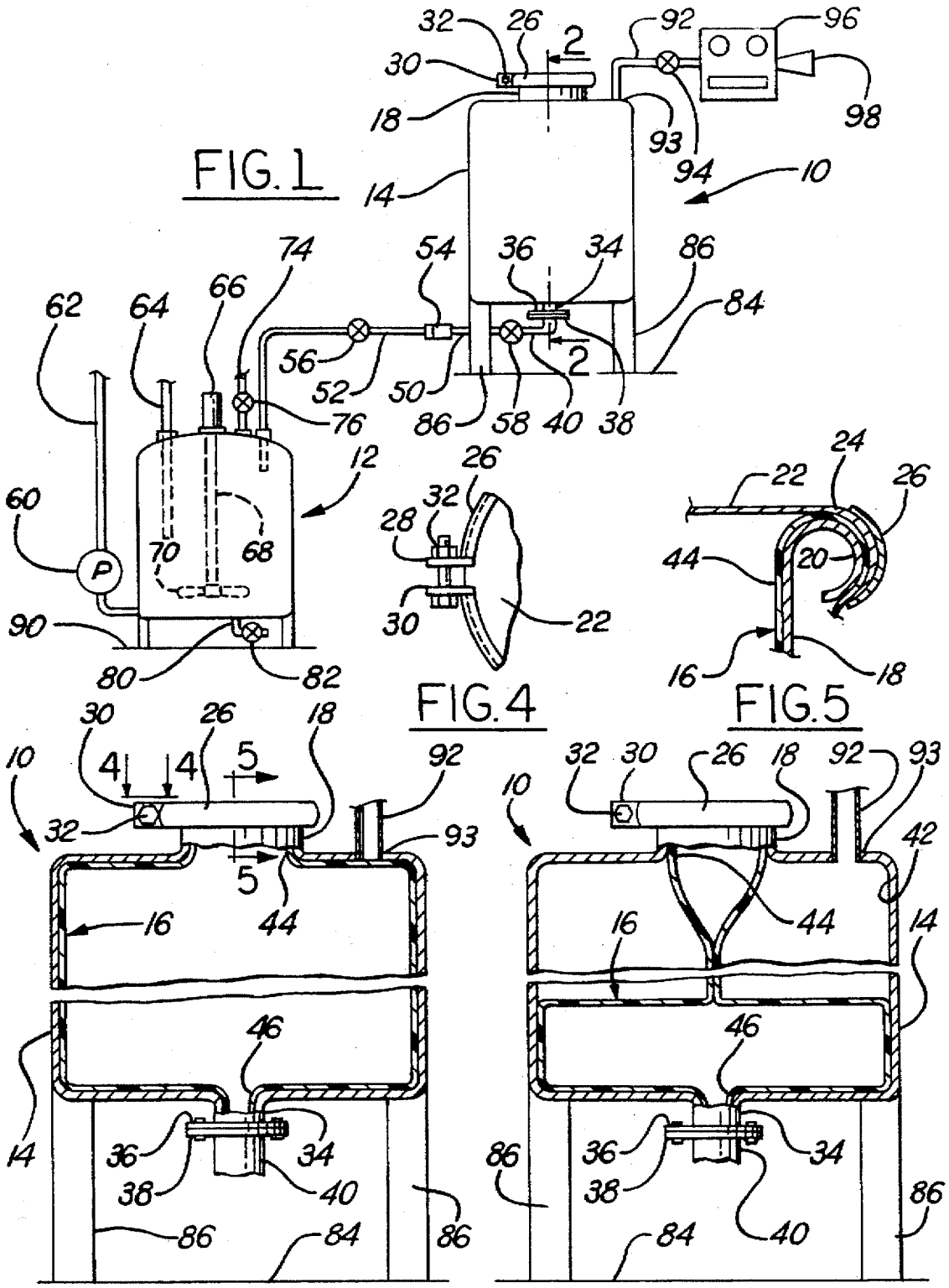
FIG.1 is a semi-diagrammatic view of apparatus for storing and dispensing paint, constructed in accordance with the invention.
FIG. 2 is a sectional view with parts broken away taken on the line 2—2 in FIG. 1 and showing the liner within the tote tank when substantially full of paint and lining the walls of the tote tank.
FIG. 3 is a sectional view similar to FIG. 2 but showing the liner after some of the paint has been withdrawn.
FIG. 4 is a fragmentary view taken on the line 4—4 in FIG. 2.
FIG. 5 is a fragmentary sectional view taken on the line 5—5 in FIG. 2.

Referring now more particularly to the drawings, the apparatus there shown comprises a paint tote 10 and a recirculation tank 12.

The paint tote 10 comprises a tank 14 having a flexible, collapsible inner liner 16, preferably made of a resinous plastic material such, for example, as polyethylene.

The tank 14 is a rigid, hollow container made of any suitable material such, for example, as stainless steel. The tank 14 has an integral tubular extension at the top forming an inlet 18. The top of the inlet has an annular, laterally outwardly turned bead 20. A closure plate 22 for the inlet has a downwardly curved, annular, radially outer edge portion 24 which fits over the bead 20 to seal the inlet. A transversely split clamping ring 26 encircles the radially outer edge portion 24 of the closure plate. The spaced apart ends 28 and 30 of the split ring 26 are bent laterally outwardly and connected by a threaded nut and bolt assembly 32 which when tightened draws the ends 28,30 together to secure the closure plate. The closure. plate is, of course, removable after first loosening the nut and bolt assembly 32 and removing the split ring 26.

The tank 14 has an integral tubular extension at the bottom forming an outlet 34. The bottom of the outlet has a laterally outwardly extending flange 36 which is bolted to a flange 38 on the end of a discharge pipe 40. A gasket seal may, if desired, be clamped between the flanges 36 and 38.

The liner 16 is in the form of a substantially closed vessel for paint which is sealed against the entry of air or contaminants and is disposed in the chamber 42 of tank 14. The upper end of the liner has a tubular extension which extends into and is concentric with tank inlet 18, forming a liner inlet 44. Liner inlet 44 has an annular upper end which is rolled over the bead 20 at the top of the tank inlet and clamped between the bead and the edge portion 24 of the closure plate 22. The liner is adapted to contain water-based or water-borne paint which may be introduced through the inlet 44 when the closure plate 22 is removed.

The liner when full of paint substantially fills the chamber 42 within the tank, lining the walls thereof as shown in FIG. 2. When filled, the liner may be slightly stretched beyond its natural free state condition, although not necessarily.

The lower end of the liner has an outlet 46 which extends into the outlet 34 of the tank. The end of outlet 46 is preferably turned laterally outwardly and clamped between the flanges 36 and 38 and sealed thereby. It has been stated that the liner is sealed against the entry of air or contaminants and this is true since the inlet 44 at the top is only for the introduction of paint and this inlet is sealed when capped by the closure plate 22. The liner should be filled with paint up to the top of the inlet to exclude any air. Likewise, the outlet 46 at the bottom is only for the discharge of paint into the pipe 40 leading to the recirculation tank 12. Pipe 40 is closed when paint is not being withdrawn.

The recirculation tank 12 is a hollow, rigid container adapted to contain paint which is supplied by the tote 10. The pipe 40 leading from the tote extends into the recirculation tank 12 to discharge paint thereinto when desired. The pipe 40 comprises two sections 50 and 52 which are connected together preferably by a quick disconnect coupling 54. Shut-off valves 56 and 58 are provided in the respective pipe sections 50 and 52. The recirculation tank 12 contains paint for immediate use which is withdrawn therefrom by a pump 60 and delivered through line 62 to a station where a painting operation is to be carried out. A return line 64 is provided for returning unused paint to the recirculation tank from the painting station.

A motor 66 on the top of the recirculation tank 12 drives a shaft 68 extending into the tank which has a propeller-like paddle or agitator 70 on the lower end. By slow speed rotation of the shaft 68, the agitator constantly stirs the paint in the recirculation tank. A pipe 74 leading into the recirculation tank 12 through the top is provided as an air bleed and also for the purpose of taking and analyzing paint samples. Pipe 74 is equipped with a shut-off valve 76. A drain line 80 at the bottom of the tank 12 is provided, equipped with a shut-off valve 82.

The tote tank 14 is supported on a supporting surface 84 by legs 86. The recirculation tank 12 is supported at a level beneath the supporting surface for the tote tank on a supporting surface 90 so that paint will flow naturally by gravity from the tote tank 14 to the recirculation tank 12.

To facilitate the collapse of the liner 16 as paint is withdrawn, an air inlet pipe 92 to the tank 14 is provided which opens into an inlet 93 in the top wall of the tank. The air inlet pipe 92 is controlled by a shut-off valve 94 and incorporates a metering device 96 for measuring the volume of air flowing into the tank which measurement serves as an indication of the volume of paint withdrawn from the liner. As the liner collapses, a slight vacuum develops between the liner 16 and the inner walls of tank 14, drawing air into the pipe 92 through inlet 98.

In use, the liner 16 within the tote tank 14 will be filled to capacity with water-based or water-borne paint through the inlet 44 at the top, the closure plate 22 having been first. removed for this purpose and then replaced to seal the contents of the liner. In this condition, the liner assumes the position shown in FIG. 2 in which it occupies the entire space within the tank and substantially fully lines the walls thereof. The tote 10 thus serves as a place for storage of paint to be supplied to the recirculation tank 12 when needed to perform a painting operation.

Paint is withdrawn from the tote by opening the shut-off valves 56 and 58 in the pipe 40 leading to the recirculation tank. The liner gradually collapses and assumes the position shown in FIG. 3 in which the top portion of the liner follows the surface of the paint downward as the paint is withdrawn so that the space within the liner is full of nothing but paint. No air or other foreign material is allowed into the liner since the inlet 44 is closed and the pipe 40 extends directly to the recirculation tank. Clearly no paint touches any part of the stainless steel tank 14, all of the paint being inside of the liner.

After a sufficient volume of paint is transferred to the recirculation tank, one or both of the shut-off valves 56,58 is closed. More paint may be delivered to the recirculation tank by simply opening both shut-off valves. After the paint has been substantially fully withdrawn from the liner 16 in the tank 14, the liner may be refilled with paint by merely removing the cover plate 22 to open the inlet 44. Normally the tote would not be refilled with paint until all or substantially all of the paint has been withdrawn from the liner, which would be a condition considerably beyond that which is illustrated in FIG. 3.

It has been found that by holding the water-based paint in a flexible liner, and ensuring that the liner contains no air or anything besides paint, undesirable paint particles will not form and interfere with the application of a perfect coat of paint.

What is claimed is:

1. A paint tote comprising a rind, hollow tank having walls defining an inner chamber, a flexible collapsible liner in the chamber of said tank, said liner being in the form of a substantially closed vessel for water-based paint sealed against the entry of air or contaminants thereinto, said liner when full of paint substantially filling said chamber and lining the walls thereof, a paint outlet extending from said liner through one of the walls of said tank for withdrawing paint from said liner, an air inlet opening into said chamber to allow the collapse of said liner as paint is withdrawn therefrom and to fill with air that portion of the chamber not occupied by the liner as the liner collapses, said tank having a tubular extension forming a tank inlet, said tubular extension terminating in an annular, laterally outwardly turned bead, said liner having a tubular extension extending into said tank inlet and forming a liner inlet for the introduction of paint, said liner inlet terminating in an annular end portion rolled over said bead, a closure plate extending across said tank inlet and having a radially outer edge portion extending over said bead and sealing said annular end portion of said liner inlet between said bead and said radially outer edge portion of said closure plate, and a clamping ring removably securing said closure plate on said tank inlet.

2. A paint tote as defined in claim 1, and further including an outlet pipe leading from said paint outlet, and a valve for opening and closing said outlet pipe.

3. A paint tote as defined in claim 2, and further including means providing an air passage leading to said air inlet, and an air metering device for measuring the volume of air entering said chamber through said passage as an indication of the volume of paint withdrawn.

4. A paint tote as defined in claim 3, wherein said liner is made of a resinous plastic material.

* * * * *